United States Patent [19]

Bauer et al.

[11] 4,214,677

[45] Jul. 29, 1980

[54] SPRAY DISPENSING CONTAINER

[75] Inventors: Daniel Bauer, Le Raincy; Gérard Braque, Mitry-le-Neuf, both of France

[73] Assignee: L'Oreal, Paris, France

[21] Appl. No.: 923,990

[22] Filed: Jul. 12, 1978

[30] Foreign Application Priority Data

Jul. 12, 1977 [FR] France ..... 77 21443

[51] Int. Cl.[2] ..... B67D 5/54

[52] U.S. Cl. ..... 222/145; 222/631; 222/635; 239/333

[58] Field of Search ..... 222/135, 137, 145, 193, 222/320, 321, 255, 263, 398, 401, 402, 630, 631, 635; 239/333, 357, 361, 355

[56] References Cited

U.S. PATENT DOCUMENTS

| | | | |
|---|---|---|---|
| 3,226,035 | 12/1965 | Boris | 239/355 |
| 3,343,797 | 9/1967 | Bach | 239/333 |
| 3,369,757 | 2/1968 | Boris | 239/333 |
| 3,904,124 | 9/1975 | Caron et al. | 222/193 |

*Primary Examiner*—H. Grant Skaggs

*Attorney, Agent, or Firm*—Brisebois & Kruger

[57] ABSTRACT

A dispenser having a reciprocating pump to feed a liquid product to a mixing chamber and an air pump with a piston to simultaneously compress and feed compressed air to the mixing chamber. The body containing the mixing chamber is mounted on the product pump and the air piston is mounted on the body. Manual pressure on the air piston is transmitted to the body which moves down to cause the product pump to reciprocate. The product pump includes a chamber with a valve which opens only after the pressure in the chamber exceeds a certain value. The air pump includes a valve which opens only after the air pressure exceeds a certain value. The air pressure valve is selected to open at the same time as the pump valve opens so that the product is dispensed as a spray.

9 Claims, 1 Drawing Figure

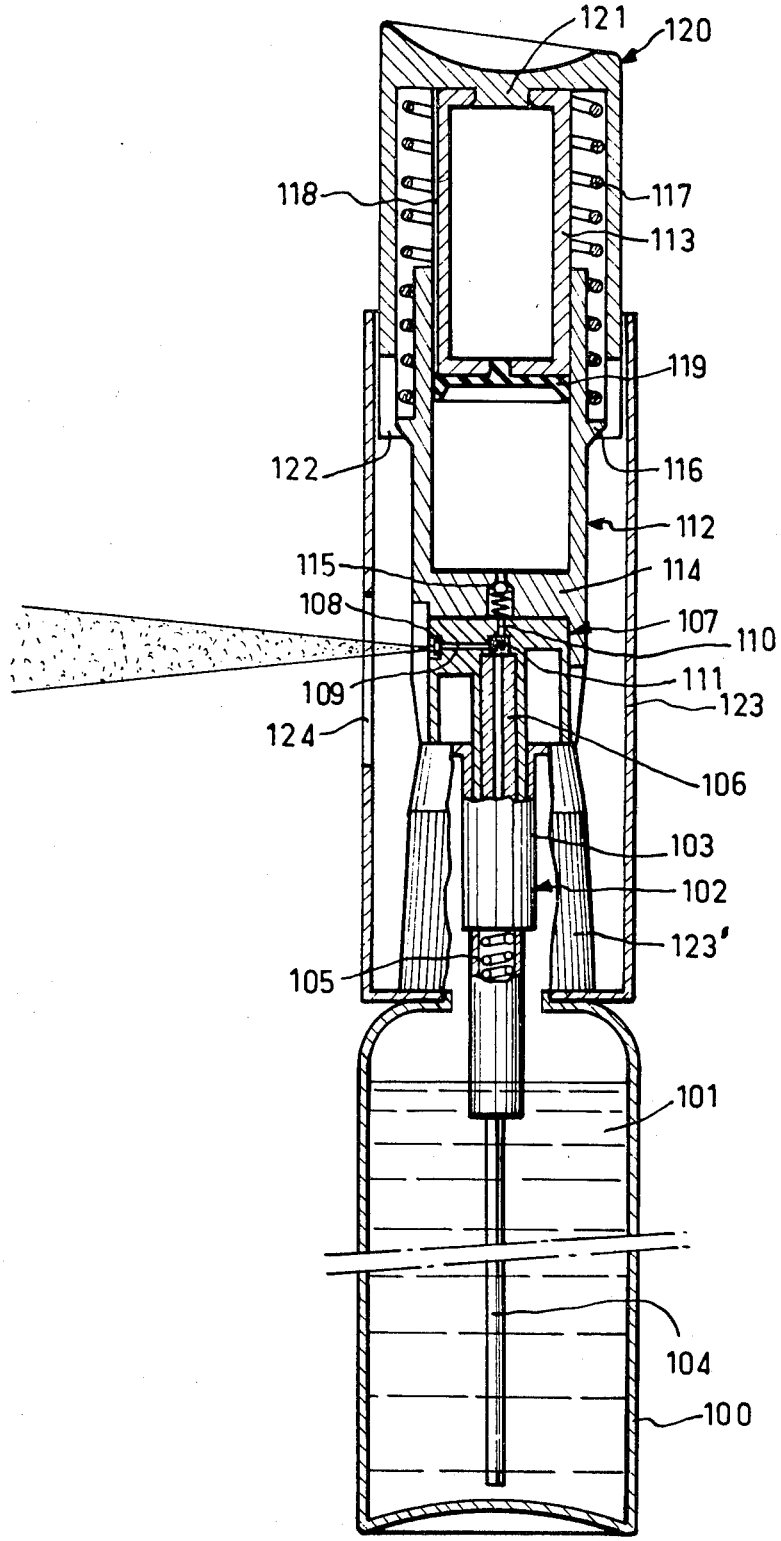
121
120
118
117
113
119
122
116
112
115
114
108
107
110
109
111
123
124
106
103
102
123'
105
101
104
100

SPRAY DISPENSING CONTAINER

In the prior art there is disclosed a container intended for dispensing a liquid product, this container being associated with dispensing means such as a push button for example a push button comprising a spray nozzle supplied by at least one outlet device, such as a valve of the container. This form of container is characterised in that near the spray nozzle, ahead of the ejection orifice of the said nozzle, the distribution device comprises at least one injection tube for additional compressed gas. It is also stated in the prior art that the injection of a supply of compressed gas simultaneously with the liquid being dispensed allows the quality of the spray to be improved by increasing the dispersion of the droplets of the spray jet. The dimensions of the droplets of the spray obtained are reduced in relation to the case where no additional compressed gas is used. To this there is added the advantage that the spray jet is accelerated so as to define an elongated cone as is necessary to ensure a satisfactory dispensing of cosmetic products in the form of an aerosol.

It is an object of the present invention to provide a new embodiment of this type of container in which the user manipulates a precompression device for the additional gas by acting directly on the mobile piston of the ejection device for the liquid.

According to the present invention we provide a container for dispensing a liquid product, this container including: a reciprocating pump which has an ejection duct including a dispensing duct terminating at a spray nozzle, and at least one injection conduit for compressed air communicating with said dispensing duct near the spray nozzle, said reciprocating stroke pump being actuated by means of a piston sliding within a compression cylinder fixed to the dispensing device, and operation of the said piston producing both actuation of the pump and injection of compressed air along said injection conduit and to said outlet.

In a preferred embodiment the injection of the compressed air is controlled by a valve capable of opening when the air pressure within the compression cylinder attains a predetermined limiting value. The reciprocating stroke pump comprises a precompression valve allowing a dose of the liquid product to be dispensed when the pressure of this dose has attained a predetermined limiting value, the inlet valve for the compressed air being set so that its opening is effected substantially at the same time as that of the precompression valve. The ejection duct or tube is connected to said pump and a dispensing conduit joins the outlet nozzle to the end of said tube remote from said pump. The injection conduit for the compressed air ends at said dispensing conduit by way of a mixer device whose outlet feeds the spray nozzle. The mixer device may be constituted by a cavity containing a sintered metal, mineral or organic material and/or a stack of metal or synthetic plates and/or a fibrous wad formed by metal, mineral or synthetic fibres and/or a foam of open cells. The piston of the compression cylinder is displaceable within the said cylinder along the axis common to the ejection conduit of the pump and to the container. The piston of the compression cylinder is subjected to the action of a return spring seated on the said compression cylinder. The piston of the compression cylinder is fixed within a cylindrical cap capable of sliding around the compression cylinder, this cap comprising an end on which the user presses in order to produce the displacement of the movable part of the pump at the same time as the injection of a charge of compressed air. The return spring is arranged round the piston within the cap, the said spring bearing on the one hand on an annular rib provided in relief on the circumference of the compression cylinder and on the other hand on the corresponding wall of the cap end. The spray nozzle and the compressed air injection conduit are formed in a body fixed to the compression cylinder and the assembly of the body and the compression cylinder is housed in a cylindrical casing arranged coaxially of the container, the casing comprising in its side wall an opening arranged opposite the spray nozzle. The said external casing comprises a floor pierced at its centre by a hole which is traversed by the neck of the container, the casing being secured on the container by means of a cod screwed onto the neck of the said container.

It will be noted that the characteristics of the spray jet formed using the above defined embodiments of dispensing container are substantially similar to those of spray jet obtained using a pressurised container containing a propellant gas, whether liquefied or not, of the type described hereinabove. There therefore follows considerable improvement in the spray at the outlet of the nozzle in relation to conventional non-pressurised containers equipped with a hand pump, where there is no provision for the injection of additional compressed air upstream of the spray nozzle. In fact the spray jets obtained with containers equipped with manual pumps of the conventional type are in general of inadequate quality for use with cosmetics, since on the one hand the droplets of the jet are not sufficiently fine and on the other hand the geometrical dimensions of the jet are not satisfactory.

On the other hand, due to the injection of additional compressed air upstream of the nozzle, the container according to the invention enables a spray jet of excellent quality to be produced for use in the cosmetic field.

In order that the present invention may more readily be understood one embodiment thereof will now be described merely by way of example and with reference to the accompanying drawings, in which the sole FIGURE shows an axial cross section of a container according to the invention for dispensing a liquid product, this container comprises a reciprocating injection pump controlled by means of a piston sliding within a compression cylinder, such that the operation of the piston produces simultaneously an injection of compressed air and the operation of the aforementioned pump.

In the drawing there can be seen a non-pressurised container 100 enclosing a liquid product 101 to be dispensed.

Container 100 is surmounted by a conventional type of reciprocating pump 102 which comprises a pump barrel 103 passing through the neck of container 100. The pump barrel 103 is positioned partly outside container 100 and partly within the said container where it is extended by a dip tube 104. In the pump barrel 103 a piston, not shown, is displaceable against the biasing action of a return spring 105 the piston being fixed to an ejection duct 106 which projects axially outwardly of pump barrel 103. The ejection duct 106 communicates, in known manner, via a precompression valve (not shown) with a dispensing chamber; this chamber also communicates with the dip tube 104 by means of a non-return valve. The aforementioned precompression valve is intended to open, that is to say to cause the dispensing chamber which contains a dose of the product to be dispensed to communicate with the ejection duct 106 of the pump, when the pressure within the precompression chamber attains a predetermined value. With each downward motion of the piston of pump 102 into the fixed barrel 103 of the pump a predetermined quantity of the liquid product 101 is delivered along the ejection duct 106. The displacement of the piston of pump 102, or of the ejection duct 106, is effected in a direction axially of the said duct whose axis is in any case identical with that of the associated container 100. The pump 102, precompression valve, non-return valve, and dispensing chamber can be of type described in U.S. Pat. No. 3,399,836, with duct 11 of the patent corresponding to duct 106 of this invention. The drawing shows duct 106 pushed down to eject a dose of product 101.

Onto the ejection duct 106 of pump 102 there is fitted a dispensing device 107 of a generally cylindrical shape. Such a device comprises an ejection nozzle 108, of a conventional type, which communicates with the ejection duct 106 of pump 102 by way of an internal tube 109. On the top wall of dispensing device 107 there is pierced at its centre a conduit 110 which extends along the axis of the ejection duct 106. The axial conduit 110 and tube 109 of the dispensing device, on the one hand, and the ejection duct 106 of pump 102, on the other hand, intercommunicate via a mixer device 111 constituted by a cavity containing a stack of fine metal plates.

On the dispensing device 107 there is fitted a compression cylinder 112 within which there may slide a piston 113. The axis of cylinder 112 is substantially identical with the common axis of the ejection duct 106 of pump 102 and the associated container 100. The compression cylinder 112 is in the form of a cylindrical duct open at its upper part and enclosed at its lower part by a floor 114 resting on the upper surface of the end of the dispensing device 107. Floor 114 is pierced by a passage wall within which there is arranged a housing intended to accommodate a spring non-return valve 115 which controls the injection of compressed air into conduit 110 feeding the dispensing conduit 109 within the dispensing device. The spring of valve 115, which controls the introduction of compressed air, is set so that its opening occurs substantially simultaneously with opening of the precompression valve of pump 102. On the lateral peripheral wall of the compression cylinder 112 there is provided an annular rib 116 in relief which serves as support for a return spring 117 which cooperates with piston 113.

Piston 113 has the form of a right circular cylinder on whose lateral wall there is arranged an air intake groove 118. This groove extends over the whole height of the piston 113 along a direction parallel to one of its generatrices. On the active side of piston 113 there is fixed a lipped gasket 119 ensuring the seal between the compression cylinder 112 and piston 113 when the piston is depressed to compress the air enclosed in the compression cylinder. After compression, and after the discharge of the supply of air contained in cylinder 112, piston 113 is capable of rising again under the action of its return spring 117 and during this action the peripheral lip of seal 119 is raised to allow air to be introduced into cylinder 112 by virtue of groove 118.

Piston 113 is fixed within a cap 120 on whose end 121 the user's finger may bear to depress the piston 113 as well as to operate the pump 102. During this depression, cap 120 is capable of displacement around the compression cylinder 112. Cap 120 comprises, on the edge of its side wall opposite the end where end 121 is connected, radially inwardly projecting stubs 122 which abut against the underside of annular rib 116 when the piston 113 is not being operated.

A cylindrical casing 123, coaxially of the axis of container 100, has been provided. The side wall of this casing 123 is pierced by an opening 124 arranged opposite the spray nozzle 108. Casing 123 is open at its upper end to allow the passage of the cylindrical cap 120. At its lower end casing 123 comprises a floor pierced at its centre by a hole through which the neck of container 100 passes. The fixing of casing 123 on the container 100 is effected by means of a cap 123' screwed onto the container neck.

When the user presses on the end 119 of cap 120 he produces downward displacement of piston 113 against the action of the return spring 117, with the effect of compressing the quantity of air contained in compression cylinder 112. At the same time, the cylinder 112 and the dispensing device 107, and therefore also the ejection duct 106 fixed to the piston of pump 102 also descend. When the pressure exerted, on the one hand, on the inlet valve 115 of cylinder 112 and, on the other hand, on the precompression valve of pump 102 is sufficient the two valves open simultaneously. This has the result that a predetermined dose of liquid 101 is ejected via the ejection duct 106 into the mixing device 111. At the same time the inlet valve 115 delivers a predetermined quantity of compressed air which enters the mixer device 111 via channelling 110. The liquid and the compressed air are ejected simultaneously along dispensing conduit 109 through the orifice of the spray nozzle. It has been found that the spray jet delivered by the nozzle 108 comprises droplets of small dimensions and that the spray jet is accelerated so as to present the shape of an elongated cone, well suited to the dispensing of cosmetic products.

When the dispensing of the dose of the product is completed, and the user relaxes his depressing action, the assembly constituted by the dispensing device 107, and the compression cylinder 112 fixed thereto, rises under the action of return spring 105 connected to the piston of pump 102. The piston 113 also returns to its initial position under the action of return spring 117. The return displacement of the piston of pump 102 results in opening of the non-return valve and the intake of a new dose of the liquid product into the dispensing chamber. Similarly the upward displacement of piston 113 of the compression cylinder 112 causes the lip of seal 119 to be raised and allows a fresh change of air to be introduced into the cylinder via groove 118 of piston 113. The user may then, if he wishes, depress the cap 120 to spray a new dose of the liquid product 101.

It will be duly understood that the embodiment described above is in no way restrictive and may be subject to any desirable modification which does not depart from the scope of the invention as claimed hereinafter.

What we claim is:

1. A dispensing container for dispensing a liquid product, comprising a reciprocating product pump having an ejection duct formed in a reciprocable element of the pump, means defining a dispensing duct communicating with the ejection duct and terminating at a spray nozzle, manually operable compression means for compressing air and mounted on said reciprocable element of the product pump, conduit means for connecting said compression means to said dispensing duct upstream of said spray nozzle, said compression means including a cylinder and a piston and comprising means for moving the reciprocable element of the product pump in response to manual movement of the piston with respect to the cylinder to both dispense the product and inject compressed air into the product, said compression means including a discharge valve, and means to prevent said discharge valve from opening until the air pressure within said cylinder attains a predetermined limiting value, the reciprocating product pump being of the type having a precompression valve for dispensing a dose of the liquid product only after the pressure of this dose attains a predetermined limiting value, and wherein said means to prevent said discharge valve for the compressed air from opening is set so that its opening is affected substantially simultaneously with the opening of said precompression valve.

2. A container according to claim 1, wherein said reciprocable element of the product pump comprises a tube connected to said product pump, said dispensing conduit joining the spray nozzle to the end of said tube remote from the product pump.

3. A container according to claim 2, further comprising an air-product mixing chamber between the compressed air conduit means and said dispensing conduit.

4. A container according to claim 3, wherein said mixing chamber comprises a cavity containing an air-product mixer selected from the group consisting of sintered metal, mineral and organic material, a stack of metal, synthetic plates, a fibrous wad formed of metal, mineral and synthetic fibers, and an open cell foam.

5. A container according to claim 1, wherein the piston of the air compression cylinder is displaceable within the said compression cylinder along an axis which is common to the ejection duct of the product pump.

6. A dispensing container for dispensing a liquid product, comprising a reciprocating product pump having an ejection duct formed in a reciprocable element of the pump, means defining a dispensing duct communicating with the ejection duct and terminating at a spray nozzle, manually operable compression means for compressing air and mounted on said reciprocable element of the product pump, conduit means for connecting said compression means to said dispensing duct upstream of said spray nozzle, said compression means including a cylinder and a piston and comprising means for moving the reciprocable element of the product pump in response to manual movement of the piston with respect to the cylinder to both dispense the product and inject compressed air into the product, said compression means further comprising a return spring bearing on said cylinder for returning said piston to an extended position with respect to said cylinder, the piston of the compression cylinder being fixed within a cylindrical cap slidable around the compression cylinder, said cap comprising an end on which the user presses to produce both displacement of the reciprocable element of the product pump and simultaneously the injection of a charge of compressed air to said conduit means, the return spring extending around the piston and within the cap, and said spring seating between an annular rib on the circumference of the compression cylinder and an end wall of the cap.

7. A container according to claim 6, wherein said compression means includes a discharge valve, and means to prevent said discharge valve from opening until the air pressure within said cylinder attains a predetermined limiting value.

8. A container according to claim 7, wherein the reciprocating product pump is of the type having a precompression valve for dispensing a dose of the liquid product only after the pressure of this dose attains a predetermined limiting value, and wherein said means to prevent said discharge valve for the compressed air from opening is set so that its opening is affected substantially simultaneously with the opening of said precompression valve.

9. A dispensing container for dispensing a liquid product, comprising a reciprocating product pump having an ejection duct formed in a reciprocable element of the pump, means defining a dispensing duct communicating with the ejection duct and terminating at a spray nozzle, manually operable compression means for compressing air and mounted on said reciprocable element of the product pump, conduit means for connecting said compression means to said dispensing duct upstream of said spray nozzle, said compression means including a cylinder and a piston and comprising means for moving the reciprocable element of the product pump in response to manual movement of the piston with respect to the cylinder to both dispense the product and inject compressed air into the product, the spray nozzle and the compressed air conduit means being formed in a body mounted on the reciprocable element of the product pump and said body and compression cylinder being positioned in a cylindrical casing extending coaxially of the container, said casing having both an opening in its side wall opposite the spray nozzle, and a floor pierced at its center by a hole through which the neck of the container extends, and cap means screwed on the neck of the container for securing the casing to the body.

* * * * *